United States Patent [19]

Asano et al.

[11] 4,153,023

[45] May 8, 1979

[54] EXHAUST GAS SENSOR TEMPERATURE DETECTION SYSTEM

[75] Inventors: Masaharu Asano, Yokosuka; Akio Hosaka, Yokohama, both of Japan

[73] Assignee: Nissan Motor Company, Limited, Japan

[21] Appl. No.: 863,604

[22] Filed: Dec. 23, 1977

[30] Foreign Application Priority Data

Dec. 28, 1976 [JP] Japan ..... 51-157568

[51] Int. Cl.[2] ..... F02B 75/10

[52] U.S. Cl. ..... 123/119 EC; 60/276; 60/285

[58] Field of Search ..... 123/119 EC, 32 EG; 60/276, 285

[56] References Cited

U.S. PATENT DOCUMENTS

| | | | |
|---|---|---|---|
| 3,616,274 | 10/1971 | Eddy | 60/276 |
| 3,827,237 | 8/1974 | Linder et al. | 60/285 |
| 3,939,654 | 2/1976 | Creps | 123/119 EC |
| 4,112,880 | 9/1978 | Asano et al. | 123/119 EC |
| 4,112,893 | 9/1978 | Anzai | 123/119 EC |

FOREIGN PATENT DOCUMENTS

| | | | |
|---|---|---|---|
| 2547142 | 4/1976 | Fed. Rep. of Germany | 123/119 EC |
| 1442917 | 7/1976 | United Kingdom | 123/119 EC |

*Primary Examiner*—Charles J. Myhre
*Assistant Examiner*—R. A. Nelli
*Attorney, Agent, or Firm*—Robert E. Burns; Emmanuel J. Lobato; Bruce L. Adams

[57] ABSTRACT

In a mixture control system having an exhaust gas sensor located in an exhaust system of an internal combustion engine for controlling the air-fuel ratio of the mixture supplied to the engine, a detection system for detecting when the temperature of the exhaust gas sensor is within its normal operating range. A deviation signal is derived from the exhaust gas sensor to represent the deviation of the air-fuel ratio within the exhaust system from a desired air-fuel ratio. The peak value of the deviation signal is detected and stored in a storage circuit and compared with a threshold which represents the normal operating temperature of the exhaust gas sensor to provide a disabling signal for the mixture control system to suspend feedback control operation when the temperature of the sensor falls below its normal operating temperature. The exhaust gas sensor is then supplied with a current in response to the presence of the disabling signal so that the voltage across the sensor's internal impedance increases because of its high impedance value at low sensor temperatures. The output from the gas sensor is compared with a preset value higher than the maximum output level of the sensor when operating at or above its normal operating temperature but lower than the minimum output level of the sensor when operating below its normal operating temperature with the current being fed. When the gas sensor output falls below the preset value, the system determines that the temperature of the gas sensor has risen above its normal operating temperature to resume feedback control operation.

10 Claims, 6 Drawing Figures

A/F RATIO DEVIATION DETECTOR
15
VSTC
PEAK DETECTOR
9
INTEGRAL CONTROLLER
16
DISABLE
POWER STAGE
17
20
VAH
VAL
VARIABLE REFERENCE SETTING
21
VH
18
VH
CURRENT SUPPLY CIRCUIT
22
V
14
EXHAUST GAS SENSOR
12
I · C ENGINE
10
AIR-FUEL MIXING & SUPPLYING MEANS
11
CATALYTIC CONVERTER
13
EXHAUST

EXHAUST GAS SENSOR TEMPERATURE DETECTION SYSTEM

FIELD OF THE INVENTION

The present invention relates to exhaust gas sensor operating systems and more particularly to an operating temperature detection system for detecting when the operating temperature of the gas sensor is within its normal operating range.

DESCRIPTION OF THE PRIOR ART

In a closed-loop controlled combustion engine wherein an exhaust gas sensor is positioned in the exhaust system of the engine for generating an output signal for controlling the air-fuel ratio of the mixture supplied to the engine, the sensor must be above a certain temperature in order to operate properly. If the gas sensor is below this temperature, the sensor operation is abnormal resulting in the internal combustion engine operating unsatisfactorily.

When the gas sensor is operating below its normal operating temperature typically after a cold start or during a prolonged idle condition, its internal impedance will become very high. However during normal temperature operations its impedance decreases to a low value and the voltage thereacross varies in response to the air-fuel ratio within the exhaust system of the engine such that it takes on a high level for richer mixture than stoichiometry and a low level for leaner mixtures.

Several prior art control systems are used to control the output of the exhaust gas sensor during the cold operation. U.S. Pat. No. 3,938,479 discloses a temperature detection system which is responsive to the voltage changes during the operation of the gas sensor and if there is no voltage changes the gas sensor is determined by the system to be cold and the control circuit for the exhaust gas sensor is not allowed to control the internal combustion engine in a feedback mode. When the closed loop control is suspended during the idle condition in which the mixture is leaned, the lean mixture inevitably results in a low output from the exhaust gas sensor. Therefore, even when the gas sensor temperature is above its normal operating level, a false output may be delivered to the detection system and as a result the closed loop suspension is meaninglessly prolonged.

SUMMARY OF THE INVENTION

The present invention contemplates that the exhaust gas sensor is fed with a current during the closed loop suspension period. Since the internal impedance of the gas sensor is very high during the cold or idle condition, the current passed through the gas sensor generates a high output across its impedance so that the minimum level of the gas sensor output is higher than a preset value. Since the internal impedance of the gas sensor decrease inversely with the temperature of the gas sensor, the voltage across the gas sensor's internal impedance decreases independently of the air fuel ratio of the mixture as represented by the oxygen content of the gases in the exhaust system and thus represents only the temperature within the exhaust system. Therefore, the reduction of the gas sensor output to a level lower than the preset value can be used as a valid signal for resumption of the closed loop operation.

It is a principal object of the invention to monitor the operation of the exhaust gas sensor and allow it to control the internal combustion engine in a feedback mode only when the sensor is within its operating temperature range.

It is another object of the invention to detect the operating temperature of an exhaust gas sensor by supplying a DC current flow to the gas sensor to increase the voltage across its internal impedance when the feedback control is disabled and monitoring the gas sensor output to resume feedback control when it falls below a preset value.

It is a further object of the invention to provide a system for detecting the operating temperature of an exhaust gas sensor wherein the system is accurately responsive to the low temperature condition of the sensor when disabling the feedback control operation and is not responsive to signals resulting from leakage currents which may be present at the output circuit of the gas sensor.

These and other objects of the invention will be understood from the following detailed description of the preferred embodiments and the drawings of a detection system for detecting the operating temperature of an exhaust gas sensor. The exhaust gas sensor is electrically connected to an exhaust gas sensor output circuit for generating a signal representative of the deviation of the concentration of a predetermined constituent gas of the exhaust gases from a preset voltage level indicative of a desired air-fuel ratio. The deviation representative signal is connected to a peak detector or storage circuit for detecting the peak value of the deviation representative signal and storing the most recent peak value of the deviation representative signal. A first detector detects when the stored peak value is below a threshold level representing the operating temperature of the gas sensor to cause the mixture control system to switch from closed to open control modes. In the open control mode the output of the first detector triggers a current supply circuit to supply the exhaust gas sensor with a DC current to increase the voltage across its internal impedance. A second detector is provided for detecting when the exhaust gas sensor falls below a preset value which is higher than the maximum output level of the exhaust gas sensor when operating at or above the normal operating temperature and lower than the minimum output level of the exhaust gas sensor when operating below its normal operating temperature in the presence of the current flow through the exhaust gas sensor so as to cause the mixture control system to switch from the open-loop to closed-loop control modes.

DESCRIPTION OF THE PREFERRED EMBODIMENTS

Figure 1:
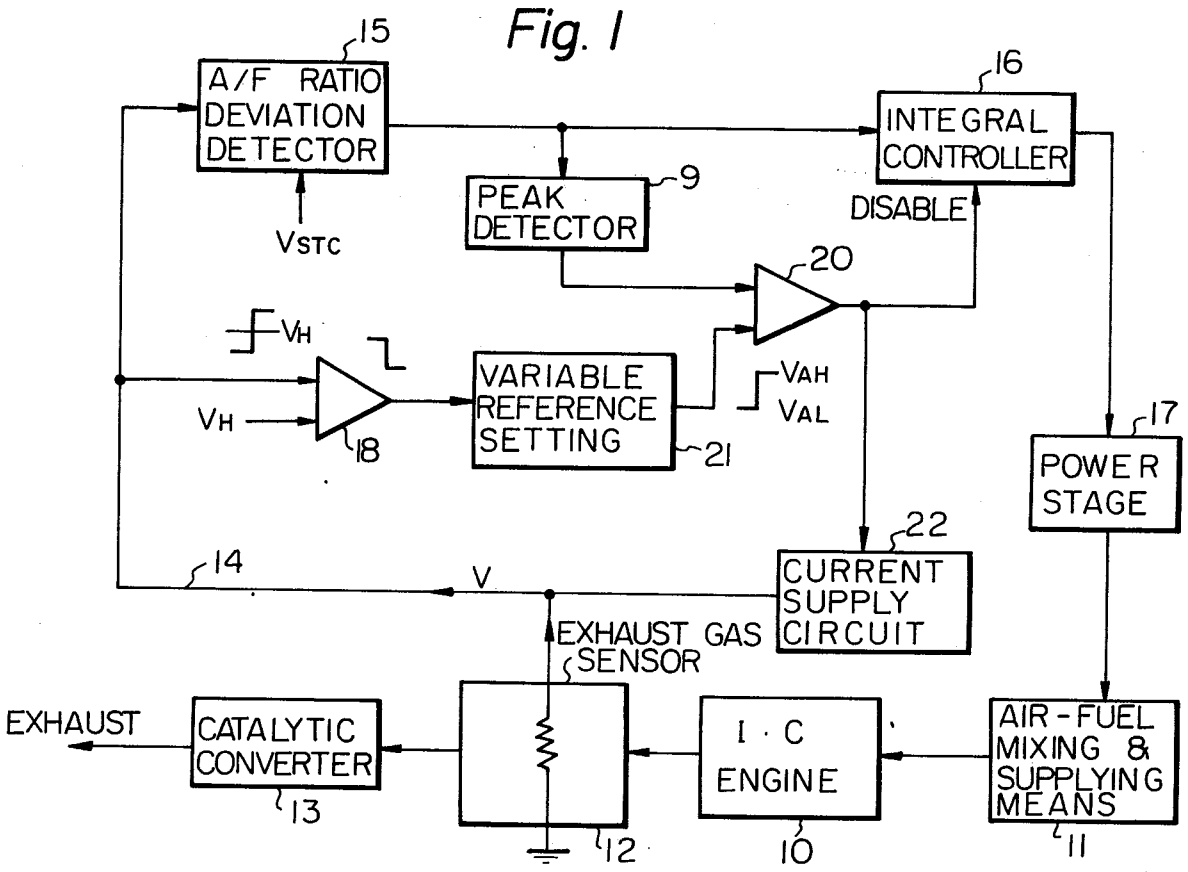
FIG. 1 is a block diagram of a temperature detection system for an exhaust gas sensor.

Referring now to FIG. 1, a closed loop controlled internal combustion engine is illustrated in functional block diagram. An internal combustion engine 10 is supplied with a mixture of air and fuel from an air-fuel mixing and supplying means 11 such as electronically controlled carburetor or injectors and emits its spent gases through the engine's exhaust system in which is disposed an exhaust gas sensor 12 and a catalytic converter 13. The exhaust gas sensor 12 is of the conventional oxygen content detector which is capable of detecting the concentration of oxygen in the exhaust emissions and generating an output V on lead 14. The output from the sensor 12 has a steep transition in voltage at the stoichiometric air-fuel ratio so that the high voltage level indicates that the mixture is richer than stoichiometry while the low voltage level indicates the mixture being leaner than stoichiometry. The catalytic converter 13 is, in a preferred embodiment, of a three-way catalysis type which accelerates simultaneous oxidation of carbon monoxide and hydrocarbon and reduction of nitrogen oxides when it is exposed to the spent gas whose oxygen content indicates the air-fuel ratio being at a point near stoichiometry. Since the three-way catalysis deteriorates in performance as the air-fuel ratio within the exhaust system drifts from the stoichiometric value, the primary function of the closed loop control is to operate the engine 10 with a mixture whose air-fuel ratio is precisely controlled at the near stoichiometry.

The output V from the exhaust gas sensor 12 is received by an air-fuel ratio deviation detector 15 whose primary function is to compare the input signal with a voltage $V_{STC}$ and generate a signal representing the deviation of air-fuel ratio within the exhaust system from the near stoichiometric value at which the three-way catalysis has a maximum conversion efficiency. The output from the deviation detector 15 is connected on the one hand to an exhaust gas sensor control circuit or integral controller 16 which provides integration of the input signal for the purpose of suppressing undesirable oscillation or fluctuation of feedback control signal which is likely to occur in response to changes in engine's operating conditions.

The output from the integral controller 16 is strengthened by an amplifier power stage 17 and applied to the air-fuel mixing and supplying means 11, and thus the engine 10 is operated in a closed loop control mode.

An additional property of an oxygen gas sensor is that at temperatures below the normal operating temperature, the internal impedance of the sensor is extremely high. As the temperature of the sensor warms up to its normal operating temperature, the internal impedance of the sensor drops from its extremely high value to its operating impedance value. The oxygen sensor operating above the normal operating temperature, will generate in the absence of oxygen gas a signal above a threshold level. More specifically, the oxygen sensor generates a first voltage higher than the threshold level in the absence of oxygen gas and a second voltage lower than the threshold level in the presence of oxygen gas.

On the other hand, when the oxygen sensor is operating below the normal operating temperature, the first voltage level in the absence of oxygen gas drops with temperature and approaches the second voltage level when the temperature is extremely low.

Therefore, the voltage level of the oxygen gas sensor 12 varies as a function of air-fuel ratios in the exhaust system of the engine as well as a function of the temperature therein.

To detect when the oxygen gas sensor 12 is operating below the normal operating temperature, the output of the gas sensor 12 is applied to an input of a comparator 18 for comparison with a preset voltage $V_H$. The comparator 18 is at a high voltage level when the oxygen sensor output is below the threshold level $V_H$ and driven to a low voltage level when the sensor output is higher than the latter.

The output from the deviation detector 15 is applied on the other hand to a peak detector 19 where the positive peak value of the detector 15 output is sensed and held for application to a second comparator 20 for comparison with a signal from a variable reference setting circuit 21. This reference setting circuit is responsive to the outputs of the comparator 18 to generate different voltage levels as described hereinbelow. The second comparator 20 is at a high voltage level when the peak detector output is below the variable threshold level and driven to a low voltage level when the former is higher than the latter. The high voltage signal from the comparator 20 indicates that the oxygen sensor 12 is operating below the normal operating temperature and it is desirable to suspend closed loop control. Thus, the high level output from the comparator 20 is used to disable the integral controller 16. Simultaneously, the disable signal causes a current supply circuit 22 to supply a current flow to the gas sensor 12 so that the voltage across its internal impedance is raised.

Figures 2, 6:
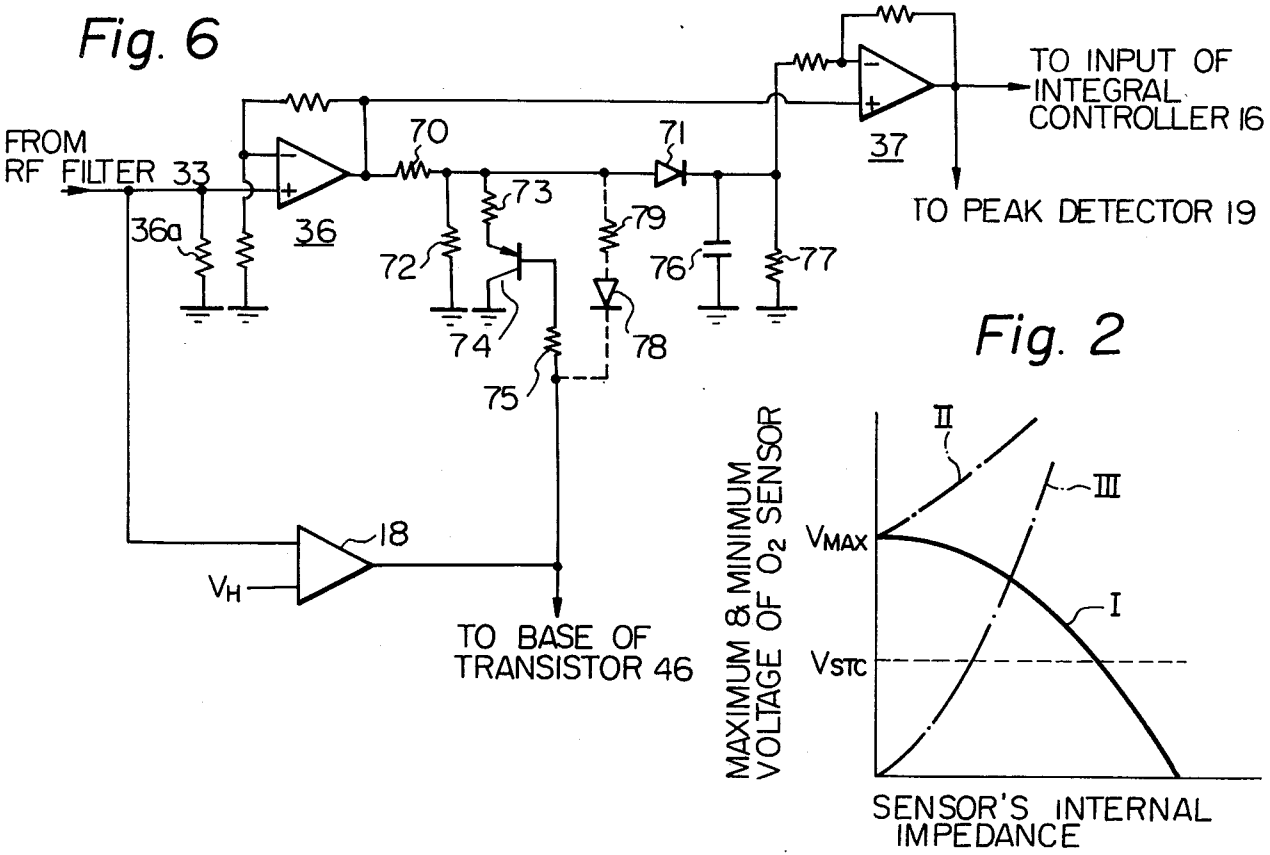
FIG. 2 is a graphic representation of the output characteristic of the exhaust gas sensor.
FIG. 6 is a modification of a deviation detector circuit of FIG. 3.

FIG. 2 is a graphic representation of the gas sensor output voltage vs. the internal impedance of the gas sensor. As the temperature of the exhaust system falls with time, the internal impedance of the sensor increased and as a result the maximum level of the sensor output voltage decreases inversely with the decrease in temperature as indicated by a solid line curve I. Whereas, the forced current flow through the oxygen gas sensor 12 from the current supply circuit 22 will cause the maximum excursion of the output voltage to rise sharply as indicated by a chain-dot line curve II and the minimum excursion of the sensor voltage, which is normally zero voltage, rises sharply as indicated by a chain-dot curve III. Since the internal impedance of the gas sensor 12 operating below its normal operating temperature is very high, the current flow during feedback suspension generates a high voltage output from the gas sensor. The internal impedance of the sensor 12 and hence the sensor output decreases inversely with its temperature, so that the end of feedback suspension can be determined by sensing when the output of the gas sensor falls below the threshold level $V_H$. Therefore, the threshold $V_H$ is set at a value lower than the minimum voltage of the gas sensor 12 when operating below its normal operating temperature with the DC current passing therethrough, but greater than the maximum voltage of the gas sensor when operating at or above its normal operating temperature with no current flow, as previously described.

Figure 3:
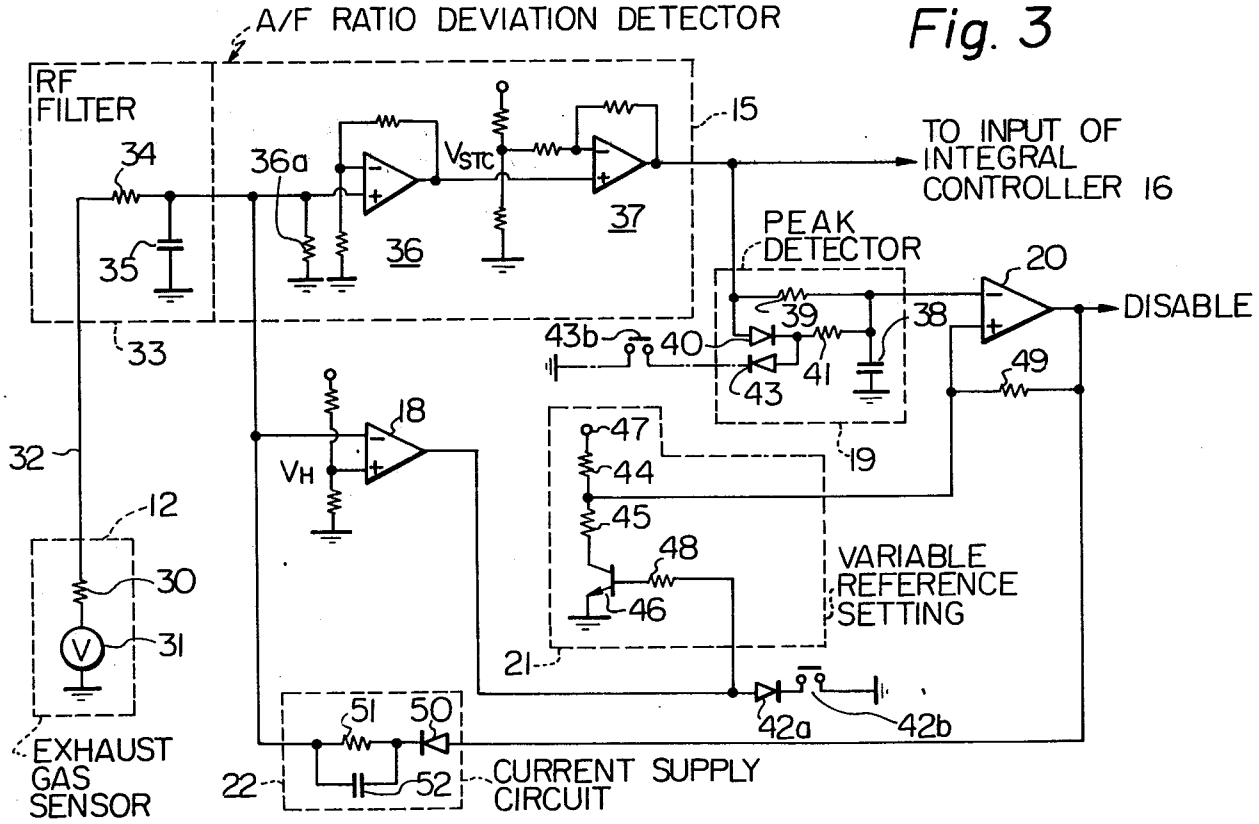
FIG. 3 is a circuit diagram of the system of FIG. 1.

A specific embodiment of the invention is illustrated in FIG. 3 for a clear understanding of the subject matter of the invention. In FIG. 3, the oxygen gas sensor 12 is represented in an equivalent circuit configuration by an internal impedance 30 and an electromotive force V which is developed across the impedance 30 as represented by a circule 31 connected in series with the impedance 30 to ground. A lead 32 from the impedance 30 of the sensor 12 is connected to an RF filter 33 comprising resistor 34 and capacitor 35, and thence to the input of the deviation detector 15. The purpose of the RF filer is to eliminate the high frequency components of the generated oxygen gas sensor output whose main, or fundamental frequency is normally of the order of 10 Hz.

The deviation detector 15 includes an operational amplifier DC buffer amplifier 36 having a high input impedance with its noninverting input connected to the junction between resistor 34 and capacitor 35 of the filter 33 and adapted for amplification of a voltage developed across an input impedance 36*a* connected between its noninverting input and ground. The output of the buffer amplifier 36 is coupled to the noninverting input of a differential amplifier 37, which computes the difference between the amplified sensor output with a fixed reference level $V_{STC}$ representing a near stoichiometric air-fuel ratio. Therefore, the output from the detector 15 is a representation of the deviation of the air-fuel ratio within the exhaust system of the engine 10 from the near stoichiometric value.

The peak detector 19, which holds the positive peak values of the deviation signal, comprises a capacitor 38 and a resistor 39 connected in a series circuit between the output of the deviation detector 15 and ground and a diode 40 and a resistor 41 in series across the resistor 39. The circuit including diode 40 and resistors 39, 41 is for charging the capacitor 38 when the deviation signal is at a high voltage level and has a smaller time constant than that of a discharge circuit formed by resistor 39 and capacitor 38.

The variable reference setting circuit 21 is comprised of a voltage divider formed by series-connected resistors 44 and 45, a switching transistor 46 connected in series with the voltage divider between voltage supply terminal 47 at a voltage Vcc and ground. The base electrode of the transistor 46 is connected by a resistor 48 to the output of the comparator 18. The junction between the resistors 44 and 45 is connected to the noninverting input of the comparator 20 for comparison with the voltage developed across the storage capacitor 38 of the peak detector 19. A feedback resistor 49 is coupled between the output of the comparator 20 and its noninverting input. The current supply circuit 22 is formed by a diode 50, a parallel connection of resistor 51 and capacitor 52 in a series circuit with the diode 50. The resistor 51 and capacitor 52 form a differentiator to build up a rapid rise in voltage sufficient to switch the comparator 18 into the low output state in response to the switching of the comparator 20 to the high output state. This prevents the occurrence of disabling and enabling signals due to the presence of the capacitive component in the input circuit of the deviation detector 15, that is, the capacitor 35, which will be discussed in more detail hereinbelow.

Figure 4:
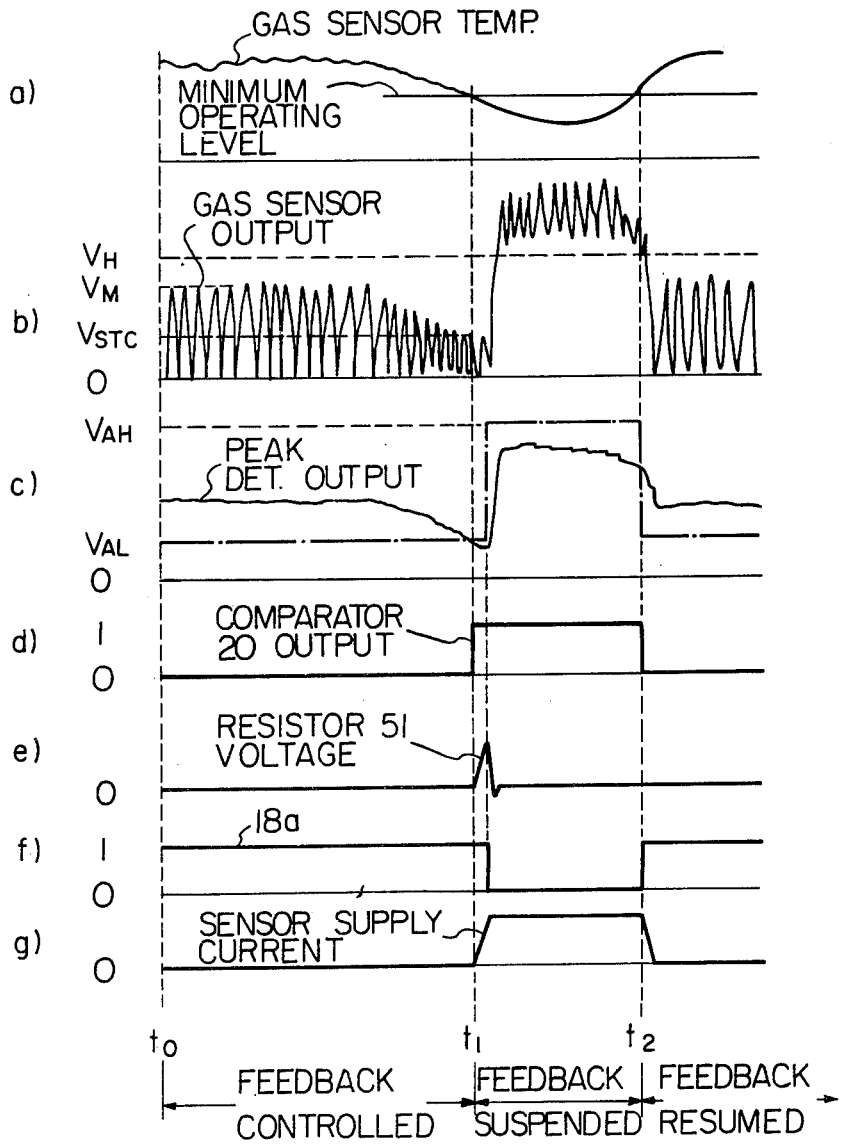
FIG. 4 is a series of waveforms appearing at various points of the circuit of FIG. 3 in relation to the temperature of exhaust gas sensor.

The operation of the circuit of FIG. 3 will be described with reference to the waveforms shown in FIG. 4. During time interval from $t_0$ to $t_1$ in which the temperature of the engine's exhaust system is above the normal operating temperature of the oxygen gas sensor 12 (FIG. 4*a*), the voltage across the input impedance 36*a* of the deviation detector 15 fluctuates between the normal maximum and minimum voltage levels (FIG. 4*b*) in response to varying concentrations of oxygen gas, thus resulting in a fluctuation of the deviation signal. The peak detector 19 senses the normal maximum voltage of the deviation signal and stores it in the capacitor 38 through diode 40 and resistors 39, 41. The voltage across the capacitor 38 is discharged through resistor 39 before the next peak arrives, so that it represents the most recent peak value of the deviation representative signal. Since voltage $V_H$ at the noninverting input of the comparator 18 is set at a value higher than the normal maximum voltage $V_M$ of the oxygen sensor, the comparator 18 delivers a high voltage output 18*a* (FIG. 4*f*) to the base of transistor 46 of the variable reference setting circuit 21 to turn it on. The turn-on of transistor 46 couples the series-connected resistors 44 and 45 in series between the voltage source 47 and ground so that the noninverting input of comparator 20 is maintained at a voltage level $V_{AL}$ which represents the normal operating temperature of the exhaust gas sensor 12 (FIG. 4*c*). Since the exhaust gas sensor 12 is normally operating above its normal operating temperature, the deviation detector output is normally higher than the threshold level $V_{AL}$ and consequently the output of comparator 20 is maintained low until time $t_1$ (FIG. 4*d*) so that during time interval $t_0$ to $t_1$ the integral controller 16 is enabled to operate the engine 10 in feedback control mode.

As a result of a prolongation of idle operation, the exhaust gas sensor temperature falls below its normal operating temperature at time $t_1$ (FIG. 4*a*) so that the peak detector output falls below the threshold level $V_{AL}$. This results in a high voltage output from the comparator 20(FIG. 4*d*), thus disabling the integral controller 16 and hence the disablement of the feedback control operation, while at the same time forward biasing the diode 50 of the current supply circuit 22. The parallel circuit of capacitor 52 and resistor 51 in the current supply circuit provides a sharply rising voltage across the resistor 51(FIG. 4*e*) in response to the presence of a high voltage signal from comparator 20. The comparator 18 is instantly biased to turn to the low output state so that transistor 46 is turned off to raise the threshold level of comparator 20 to $V_{AH}$. This ensures against possible instability of the during its switching period.

The exhaust gas sensor 12 will then be fed with a current supplied from the current supply circuit 22. Since the internal impedance of the gas sensor 12 under the low temperature condition is extremely high and since the input impedance of the buffer amplifier 36 is also high, the voltage across the input impedance 36*a* is representative of the high voltage fluctuation of the exhaust gas sensor 12 so that the inverting input of comparator 18 will exceed the threshold level $V_H$, thus the comparator 18 is maintained in the low voltage state. Because of the high input impedance of the buffer amplifier 36, there is at least likelihood of the comparator 18 operating in response to a false signal resulting from leakage paths which may exist in the connecting lead 32 and ground.

As the temperature within the exhaust system rises in response to the end of the idling operation, the internal impedance of the sensor 12 decreases with the consequential decrease in the sensor 12 output. It is assumed that at time $t_2$ the output level of the sensor 12 falls below the threshold level $V_H$, and a high level output results from the comparator 18 to turn the transistor 46 on. The turn-on of transistor 46 couples the ground potential to the voltage dividers 44, 45 so that the bias level of the noninverting input of comparator 20 decreases to a level lower than the peak detetector output. The comparator 20 is thus switched to a low voltage state (FIG. 4*d*) to allow the integral controller 16 to resume feedback control operation and at the same time couples a low voltage signal to its noninverting input through resistor 49. The potential at the noninverting input of the comparator 20 is reduced to the lower voltage level $V_{AL}$.

In response to the presence of a low voltage at the output of comparator 20, the current through the exhaust gas sensor 12 is ceased (FIG. 4*g*). Since, during the closed loop suspension, the exhaust gas sensor 12 is maintained at a relatively high voltage level by the forced current flow, the resumption of feedback control is only responsive to the exhaust gas sensor temperature and consequently the adverse effect of a lean condition within the exhaust system of the engine on determining the resumption of feedback control is eliminated so that a meaningless prolongation of the feedback suspension after the condition for the feedback operation is justified, can be effectively eliminated.

Figure 5:
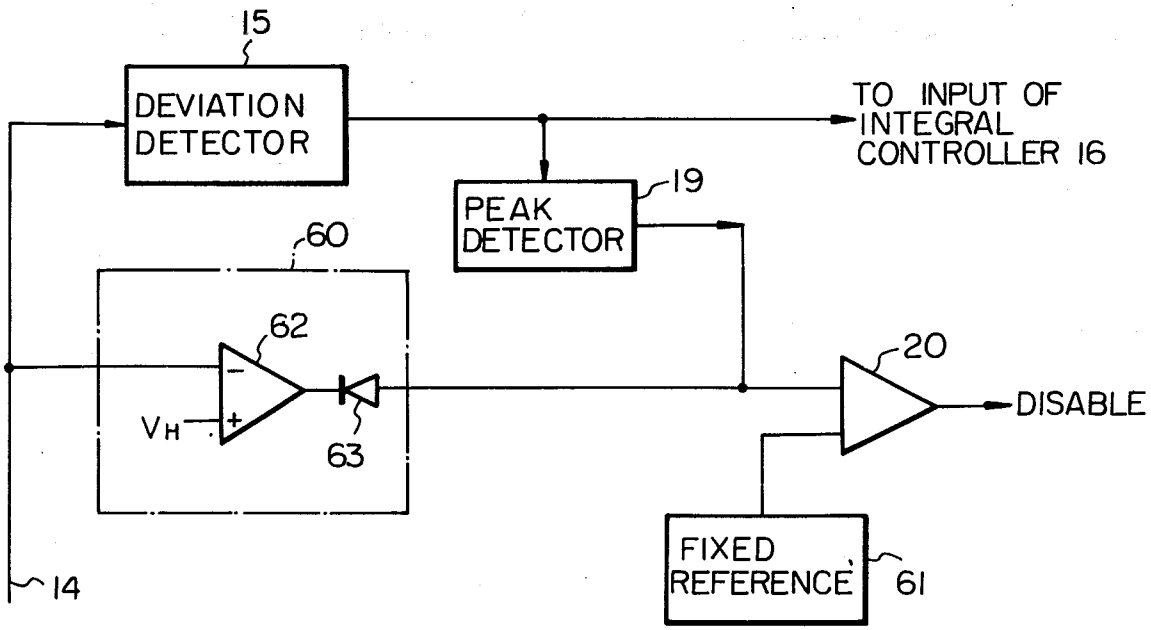
FIG. 5 is a modified block diagram of the system of FIG. 1.

The embodiment of FIG. 1 can be modified as shown in FIG. 5 which is generally similar to the previous embodiment with the exception that the peak detector 19 output is discharged through a discharge circuit 60 and the threshold level of the comparator 20 is maintained at a fixed level from source 61. As illustrated in FIG. 5, the discharge circuit 60 is comprised of a comparator 62 having its noninverting input biased at the potential $V_H$ to detect when the exhaust gas sensor output rises above that threshold level to couple a low voltage to its output to discharge the energy stored on the capacitor 38 of the peak detector 19 through a diode 63. With this circuit arrangement, the peak detector 19 is held at a minimum voltage level during the feedback suspension period, rather than allowing it to rise with the sensor output as in the previous embodiment, so that the output level of the comparator 20 is held at the high level during the feedback suspension period.

Referring again to FIG. 3, a diode 42*a* and a starter switch 42*b* are connected in a series circuit between the output of the comparator 18 and ground. This series circuit is to avoid a problem which could occur when on-off switching operations of the engine's ignition switch is repeated twice before the engine's starter switch is turned on. The problem is that feedback operation cannot be suspended for a certain period of time when the engine is started for idling.

The starter switch 42*b* is arranged to be operated in response to or in cooperation with the engine's starter switch (not shown). The turn-on of switch 42*b* connects the ground potential to the base electrode of the transistor 46 to turn it off so that the threshold level of the comparator 20 will be instantly raised to the higher voltage level $V_{AH}$ to thereby produce a disabling signal at the output of the comparator 20. The same problem can also be eliminated by a series circuit including a diode 43*a* and a starter switch 43*b* which is arranged to be operated in response to or in cooperation with the engine's starter switch as described above. The operation of the switch 43*b* connects the junction between the diode 40 and resistor 41 of the peak detector 19 to ground so that the voltage across the storage capacitor 38 is instantly discharged through diode 43 to thereby reduce the potential at the inverting input of the comparator 20 to a level lower than the threshold, thus resulting in a high voltage output from the comparator 20.

FIG. 6 is a modification of the deviation detector 15 of FIG. 3. In this modification, the output of the buffer amplifier 36 is connected on the one hand to the noninverting input of the differential amplifier 37 and on the other hand through a series circuit including a resistor 70 and a diode 71. To the junction between resistor 70 and diode 71 is connected a resistor 72 coupled to ground in parallel with a series circuit including a resistor 73 and a transistor 74, with the base electrode being connected by a resistor 75 to the output of comparator 18. The inverting input of the differential amplifier 37 is connected to ground by a parallel circuit including a capacitor 76 and a resistor 77.

The parallel RC circuit 76, 77 and the diode 71 constitute an averaging circuit which provides a time integral signal to represent the mean value of the exhaust gas sensor output over an extended period of time. The resistors 70 and 72 from a voltage divider whose divided output (for example, one half of the output voltage of buffer amplifier 36) is coupled through the diode 71 to charge the capacitor 76. This time integral representation of the sensor output varies the threshold level of the differential amplifier 37 as a function of time, or aging so that the control point of the feedback loop is varied as a function of time to give the most appropriate air-fuel mixture ratio.

The transistor 74 is biased into conduction when the output of the comparator 18 is low, i.e. when feedback control is suspended. The turn-on of transistor 74 clamps the junction between the resistors 70 and 72 to a potential to a low level. Since, during the feedback suspension period, the gas sensor output is deceptively high, this clamping action maintains the voltage across the capacitor 76 of averaging circuit at a value appropriate for resumption of feedback control instead of allowing it to rise with the gas sensor output. If the time integral signal of the average circuit is allowed to rise with the gas sensor output, the control point of the closed loop is excessively high for the normal feedback operation and satisfactory operation is not achieved. Alternatively, a diode 78 and a resistor 79 in a series circuit may be connected between the output of the comparator 18 and the anode of diode 71 instead of using transistor 74 and resistors 73 and 75. The diode 78 is so poled to conduct current when the comparator 18 is at a low voltage level.

What is claimed is:

1. In a mixture control system for an internal combustion engine having an exhaust gas sensor for supplying a control signal to the mixture control system, a detection system for detecting when the temperature of the gas sensor is at or above its operating temperature to allow said mixture control system to operate said engine in a closed-loop control mode and detecting when the temperature of the gas sensor is below its operating temperature to allow said mixture control system to operate the engine in an open-loop control mode, wherein said sensor is operable at a high temperature for generating a voltage signal representative of the concentration of a predetermined constituent gas in the exhaust gases, said sensor having an internal impedance varying inversely with the temperature of said sensor from a very high impedance at its low, nonoperable temperature to a very low impedance at its high operating temperature, said detection system comprises:

exhaust gas sensor output circuit means for generating a signal representative of the deviation of said concentration representative voltage signal from a predetermined voltage level representing a desired air-fuel ratio;

storage circuit means for detecting the peak value of said deviation representative signal and storing the most recent peak value of the deviation representative signal;

a first detector for determining the relative voltage level of the output of said storage circuit means to the voltage level of a first threshold representing the normal operating temperature of said exhaust gas sensor to cause said mixture control system to operate in the feedback control mode when the output of said storage circuit means is greater than said threshold level or cause said mixture control system to operate in the open control mode when the output of said storage circuit means is smaller than said threshold level;

means for supplying a current flow to said exhaust gas sensor in response to the presence of said disabling signal to thereby increase the voltage across its internal impedance; and a second detector for determining the relative voltage level of the output of said exhaust gas sensor to the voltage level of a second threshold higher than the maximum output level of the exhaust gas sensor when operating at or above the normal operating temperature, and lower than the minimum output level of the exhaust gas sensor when operating below its normal operating temperature in the presence of said current flow, for switching the control modes of said mixture control system from the open to closed modes when the increased voltage output of said exhaust gas sensor falls below said second threshold as the output of said gas sensor decreases inversely with the temperature of the gas sensor.

2. A detection system as claimed in claim 1, wherein said first detector comprises:

reference setting means for establishing a threshold level representative of the normal operating temperature of said exhaust gas sensor;

a comparator having a first input connected to said storage circuit means and a second input connected to said reference setting means, the output of said comparator being an enabling signal for said mixture control system to operate the engine in the feedback control mode when the output from said storage circuit means is greater than said threshold level and being a disabling signal for said mixture control system to operate the engine in the open control mode when the output from said storage circuit means is smaller than said threshold level; and means for varying the relative level of the voltage at the first input of said comparator to the voltage at the second input of said comparator such that the voltage level of the first input is lower than the voltage level of the second input in response to the presence of said open-loop control mode.

3. A detection system as claimed in claim 2, wherein said means for varying the relative voltage of the inputs of said comparator comprises second means for setting a threshold voltage lower than the minimum level of said concentration representative voltage signal which is generated in the presence of said current flow, a second comparator having a first input connected to respond to said concentration representative voltage signal and a second input connected to said second reference setting means, the output of said second comparator being a signal for holding the voltage level of the first input of said first-mentioned comparator at a level lower than the voltage level of the second input thereof.

4. A detection system as claimed in claim 3, wherein the first-mentioned reference setting circuit means includes a switching transistor responsive to the output of said second comparator for increasing said threshold level to a level higher than the peak value of deviation representative signal in the presence of said open-loop control mode.

5. A detection system as claimed in claim 3, further comprising a diode connected between the output of said storage circuit means and the output of said second comparator for discharging the stored energy of said storage circuit means so that the voltage at the first input of said comparator is lower than said threshold level.

6. A detection system as claimed in claim 2, wherein said exhaust gas sensor output circuit means comprises an input impedance circuit connected to said exhaust gas sensor for developing a voltage representative of said concentration representing voltage signal, a buffer amplifier having a high input impedance value operable to amplify the voltage developed across said input impedance circuit, and a differential amplifier having a first input connected to the output of said buffer amplifier and a second input biased at a reference level representing said desired air fuel ratio to generate said deviation representative signal.

7. A detection system as claimed in claim 6, further comprising a filter circuit connected between said exhaust gas sensor and said buffer amplifier to eliminate the high frequency components of said concentration representing voltage signal.

8. A detection system as claimed in claim 7, wherein said current supplying means includes a differentiating circuit to generate a rapid rise in voltage in response to the presence of said open-loop control mode, and wherein said means for varying the relative voltages of the inputs of said comparator comprises second circuit means for setting a second reference voltage lower than the minimum level of said concentration representative voltage signal in the presence of said open-loop control, a second comparator having a first input connected to the output of said filter circuit in parallel with said input impedance and said differentiating circuit and a second input connected to said second reference setting circuit means, whereby said second comparator is responsive to the output from said differentiating circuit for varying the relative levels of the inputs of said first comparator such that the voltage at the first input is lower than the voltage at the second input thereof and said second comparator is responsive to the voltage developed across said input impedance circuit being lower than said second reference level for reversing the relation of said voltages at the first and second inputs of said first comparator.

9. A detection system as claimed in claim 6, wherein said exhaust gas sensor output circuit means includes means connected to the output of said buffer amplifier for generating a time integral voltage signal for application to the second input of said differential amplifier to represent said desired air fuel ratio, and means for holding the time integral voltage signal at a level lower than the minimum level of the output from said buffer amplifier in the presence of said open-loop control mode.

10. A detection system as claimed in claim 2, wherein said voltage level varying means includes manually operable means responsive to the operation of an engine starting switch for varying the relative level of the voltages at the inputs of said comparator so that the voltage at the first input of the comparator is below the voltage at the second input thereof.

* * * * *